US005284551A

United States Patent [19]

Beran et al.

[11] Patent Number: 5,284,551

[45] Date of Patent: Feb. 8, 1994

[54] PAPER MACHINE DECKLE BLADE CONSTRUCTION

[75] Inventors: Robert L. Beran; Stephen Nicholson; Mark A. Taylor, all of Covington, Va.

[73] Assignee: Westvaco Corporation, New York, N.Y.

[21] Appl. No.: 965,007

[22] Filed: Oct. 23, 1992

[51] Int. Cl.[5] ..... D21F 1/56

[52] U.S. Cl. ..... 162/353; 15/256.5; 162/272

[58] Field of Search ..... 162/272, 353, 281, 208, 162/331; 15/256.5, 256.51

[56] References Cited

U.S. PATENT DOCUMENTS

| | | | |
|---|---|---|---|
| 1,818,712 | 8/1931 | Hinkson | 162/353 |
| 3,014,833 | 12/1961 | Lee | 162/281 |
| 3,410,206 | 11/1968 | Dorr | 15/256.51 |
| 3,607,624 | 9/1971 | Moody et al. | 162/272 |
| 4,124,441 | 11/1978 | Nykopp | 162/353 |
| 4,648,705 | 3/1987 | Tachibana | 15/256.51 |
| 4,738,751 | 4/1988 | Newcombe | 162/353 |
| 4,803,752 | 2/1989 | Kasama | 15/256.51 |
| 4,957,045 | 9/1990 | Messerschmitt | 15/256.5 |
| 4,968,387 | 11/1990 | Beran et al. | 162/353 |

*Primary Examiner*—Karen M. Hastings

*Attorney, Agent, or Firm*—J. R. McDaniel; W. A. Marcontell; R. L. Schmalz

[57] ABSTRACT

To protect the paper machine fourdrinier screen, deckle blades are fabricated with a soft polymer (polytetrafluoroethylene) lower edge having little adhesive affinity for either papermaking fiber or traditional plastic bonding compounds. Necessary structural rigidity is contributed to the assembly by a mechanical cladding of suitably stiff polymer plates that are adhesively bonded to a compatible plastic mounting body.

6 Claims, 2 Drawing Sheets

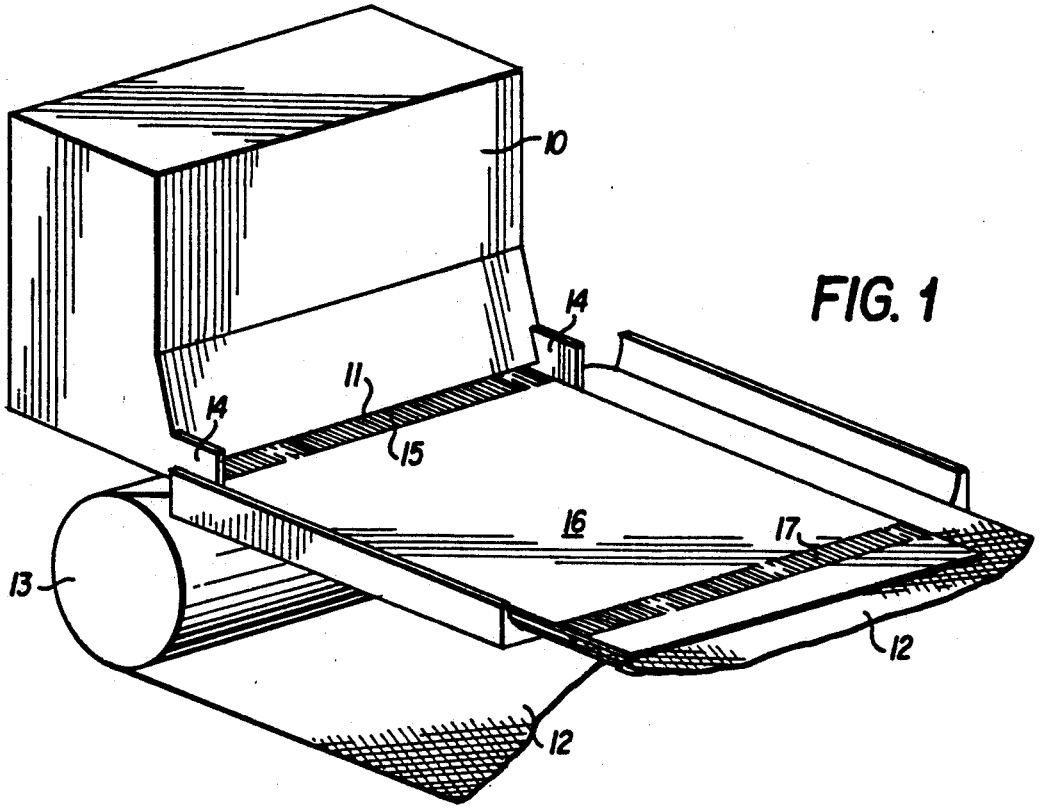
FIG. 1
FIG. 2
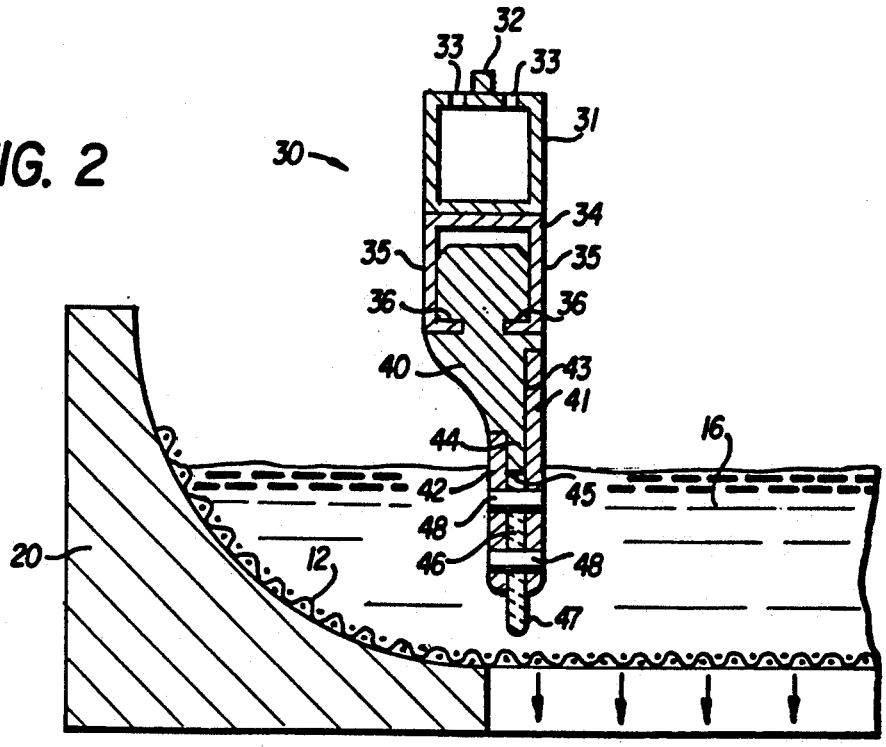

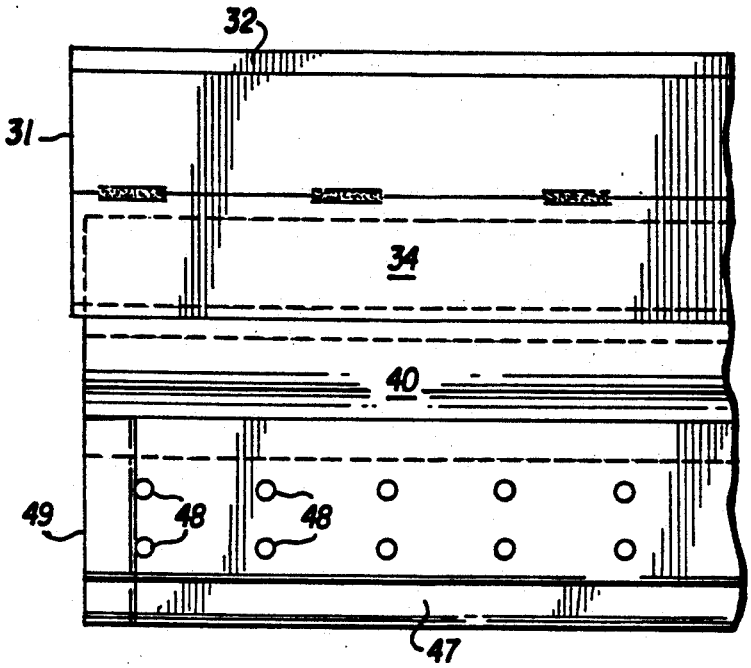
FIG. 3
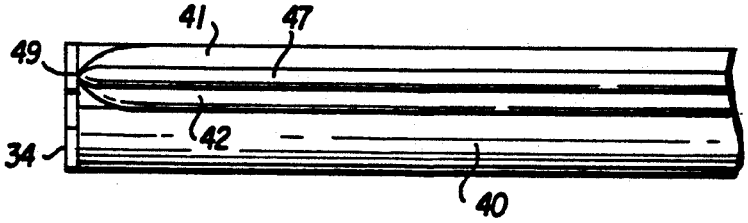
FIG. 4
FIG. 5
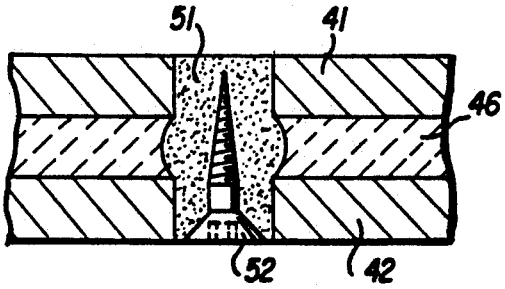
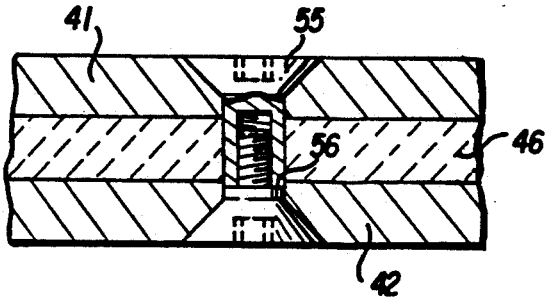
FIG. 6

PAPER MACHINE DECKLE BLADE CONSTRUCTION

BACKGROUND OF THE INVENTION

1. Field of the Invention

The present invention relates generally to fourdrinier paper machines. More specifically, the present invention relates to assembly design and material selection for deckle structures used to confine a papermaking stock pond carried on a fourdrinier screen.

2. Description of the Prior Art

Fourdrinier paper machines are characterized by a closed loop web formation screen driven over an open, flat table surface. Extremely dilute, aqueous papermaking stock is jetted upon the traveling screen from a horizontally elongated nozzle; usually associated with a stock accumulation chamber called a headbox.

As the traveling screen carries the stock flow from the slice jet landing zone, aqueous vehicle, i.e., water, drains through the screen to leave the fiber constituent of the papermaking stock accumulated upon the upper screen surface as a consolidated mat.

Between the stock landing zone and that longitudinally displaced point along the screen belt traveling route whereat the mat consolidates into a paper web, the stock is supported on the screen surface as a liquid pond of diminishing depth. Without lateral containment, lateral liquid stock flow cross-directionally sweeps fiber stock towards the screen sides thereby undesirably tapering the paper web edge thickness.

To prevent such undesirable thickness tapering along the paper web edges, lateral pond confinement structures called "deckle boards" are positioned above and along the screen edges in the machine direction from the slice landing zone. Traditionally, deckle boards are similar to a pair longitudinal dams, each extending along the screen traveling direction respective to each lateral edge of the screen with the screen per se running under the deckle boards.

Elastomer skirts secured to the deckle board rigid structure drag against the underrunning screen for a partial fluid seal. To protect the screen from premature destruction, the elastomer is chosen to be significantly softer than the screen material.

A more recent innovation to the deckle structure has been to combine the deckle board with a screen edge cupping rail located outboard of the deckle board, as represented by U.S. Pat. No. 4,968,387 to R. L. Beran et al. The curled screen edges, traveling along respective, oppositely cupped rail profiles, hydraulically confine the stock pond. The deckle boards, internally of the cupped rails, are vertically positioned above the screen as to leave a substantial hydraulic channel beneath the lower deckle board edge. Machine white water fills the flow channel between the cupping rail and the outside surface of the deckle board. The inside faces of the deckle boards delineate the outer edge limits of the stock fiber. Standing waves generated in the stock pond are permitted to pass under the deckle board into white water channel and dissipate up the edge cup profile without reflection.

Although deckle boards that are operatively combined with screen edge cupping rails do not normally contact the screen, under certain production circumstances, the lower deckle edge is sufficiently close to the screen that frequent contact is inevitable. For this reason, need remains for a soft lower edge for the deckle blade.

Parallel developments have shown that the original generation of formation table deckle waves or waves which may develop from the trailing edge of a deckle blade may be substantially reduced or eliminated by extremely thin and smooth deckle blade construction. Unfortunately, most practical engineering materials that are sufficiently strong and rigid to be usefully thin and smooth are also much harder and tougher than the formation screen material. Consequently, use of thin, smooth deckle blades to eliminate forming table deckle waves has the potential for dramatically reducing the production life of the formation screen.

SUMMARY OF THE INVENTION

It is, therefore, an object of the present invention to provide a thin, smooth deckle blade with a soft lower edge while satisfying all functional requirements.

Another object of the present invention is to secure a thin plate of polytetraflouroethylene (Teflon) between two polished surface plates of polycarbonate (Lexan).

Another object of the present invention is to provide an extremely reliable system for securing a laminated assembly of polytetraflouroethylene plate between polycarbonate plates.

These and other objects of the invention are accomplished by a composite deckle blade wherein the dominant wetted surface area of the blade is polished polycarbonate but projected below the external cladding of the polycarbonate blade sides is a polytetraflouroethylene blade edge.

A polymethylmethacrylate (Plexiglas) blade support structure is machined to fit an unusually clean surface frame mounting appliance. Stepped flats in the blade support body receive upper edges of the external cladding sides for a flush or smoothly transitioned exterior blade surface.

A spacing tongue between the steps secures a parallel separation dimension between the inside faces of the external cladding sides to receive the dimensioned thickness plate of polytetraflouroethylene. To secure the Teflon plate within this separation channel, transverse dowel pins of a material having adhesive compatibility with the cladding sides are inserted. Alternatively, expansion anchors or threaded compression pins may be used.

DESCRIPTION OF THE DRAWINGS

Relative to the drawings wherein like reference characters designate like or similar elements throughout the several figures of the drawings:

FIG. 1 is an abbreviated pictorial of a paper machine headbox section;

FIG. 2 is a detail of the invention in operative combination with a screen edge cupping rail;

FIG. 3 is an elevational detail of the present deckle blade assembly;

FIG. 4 is a bottom plan detail of the present deckle blade assembly;

FIG. 5 is a sectional detail of an alternative assembly pin structure; and

FIG. 6 is a sectional detail of another alternative assembly pin structure.

DESCRIPTION OF THE PREFERRED EMBODIMENT

For environmental setting, FIG. 1 illustrates the relevant elements of a fourdrinier paper machine as comprising a headbox 10 which discharges dilute, aqueous papermaking stock from a slice opening 11 onto a horizontally carried, table segment of an endless belt screen 12. The screen is turned about and drawn from a breast roll 13 under headbox 10. Extensions 14 from the slice end wall, characterized as "pond sides" or "cheeking pieces," confine the fluid stock beyond the plane of discharge from the slice and may include the line of stock landing 15.

Dynamically, the jet of fluid stock lands upon the screen 12 which is moving at approximately the same horizontal velocity as the stock jet. Although drainage of the stock aqueous vehicle begins immediately, the initial drainage process continues for several seconds during which the stock remains as a highly fluidized pond 16. As this pond is carried away from the slice opening 11, water removal diminishes the pond depth until sufficient free water is removed to form a consolidated fibrous mat 18. That point of mat consolidation is observed on the paper machine as a "dry line" zone 17. Thus formed, the mat is further dried by pressure and heat to an integral, continuous paper web.

In transit, the pond 16 is laterally confined by deckling components such as the screen edge cupping rail 20 and the deckle board assembly 30 illustrated in section by FIG. 2. Although described in combination with the cupping rail 20, it should be understood that the present invention is not so limited and may be used independently.

In the preferred embodiment, the deckle board 30 is an assembly of two major components comprising the primary frame elements and the conveniently replaceable blade elements. Frame elements 31 and 35 are usually fabricated of steel or a suitable non-ferrous metal alloy whereas the blade elements are fabricated of selected, engineering plastics. The frame elements are rigidly secured to the paper machine structure by means such as that described by U.S. Pat. No. 3,607,624 and except for location trim adjustments, are not easily removable. The blade elements are designed to be expendable and easily replaced.

Primary frame element 31 is a flushing fountain comprising a square fluid conduit having a mid-line fluid flow barrier 32 flanked by conduit penetrating apertures 33.

Secured below the flushing fountain 31, by welding, for example, is square section C-clip 34 having guide rails 36 at the distal ends of suspension walls 35.

Guide rails 36 confine and support the expendable blade elements of the invention which include a support body 40 to which blade cladding plates 41 and 42 are secured as by adhesive bonding compounds. In support of a uniformly distributed flushing film over the blade surface, support body 40 is machined or molded with stepped areas 43 and 44 to receive a corresponding area of cladding plates 41 and 42 separated by a spacing tongue 45.

Cladding plate material suitable to provide necessary stiffness and rigidity may be polished polycarbonate (Lexan) whereas the support body 40 may be polymethylmethacrylante (Plexiglas). More generally, both plate and body materials should be of hard, tough polymer that may be polished to an exceedingly smooth surface and is dimensionally stable. Both plate and body may be Lexan or Plexiglas.

Between the two cladding plates 41 and 43 is a polytetrafluoroethylene (Teflon) soft blade plate 46 having a blade edge 47 projecting ½ inch to 1 inch below the lower edge of cladding plates 41 and 42. Although adhesive may be used on the interface between the cladding plates and the edge plate, the bond is usually less than reliable. Furthermore, the risk of adhesive bond failure is particularly great in the operating environment of a paper machine. Structural debris in a paper machine resulting from such adhesive bond failure is unacceptable due to the potential for great damage to fabrics, foils and other equipment or personnel. Accordingly, the blade assembly is secured by transverse shear pins 48 comprising dowels of a material that is adhesively compatible with the cladding plates 41 and 42.

Although the invention is presently perceived in the context of adhesively anchored shear pins, experience may provide that press-fit pins are sufficient. For removal and replacement of the polytetrafluoroethylene plate, secured by press-fit pins, only a drive or press punch is required. Dowel pins secured adhesively usually must be drilled away.

FIGS. 5 and 6 illustrate alternative embodiments of the present invention shear fasteners. In FIG. 5, the transverse pins 51 are of relatively soft polymer capable of force flow displacement. A countersunk screw 52 causes the pin 51 to grow by a volume directly proportional to the screw 52 volume.

The pin embodiment of FIG. 6 provides a two-part, reusable countersunk screw fastener 55 that can be set against a shoulder 56 to a predetermined length.

Note should be given to the preferred dimensional relationships wherein the total blade length is 10 to 15 feet long and the depth is 6 to 8 inches. Thickness of the blade, however, is on the order of ⅜ inch with the cladding plates 41 and 42 and soft blade plate 46 each being ⅛ inch thick.

The bottom plan view of FIG. 4 shows the blade trailing edge 49 to be tapered for the purpose of further minimizing pond flow disturbance and consequential wake generation.

Having fully disclosed our invention, numerous alternative and mechanically equivalent design configurations may be devised by those of ordinary skill in the art for particular invention features. As our invention, however,

We claim:

1. In a paper machine having a forming screen, a paper machine deckle blade comprising an elongated, polymer support body, said support body having an elongated channel formed by a pair of plates separated by a spacing tongue of said support body, said support body having a pair of stepped areas to receive a respective corresponding area of said plates so as to form an exterior surface flush with said support body, said plates are operatively attached to a blade edge which is constructed of a polytetrafluoroethylene compound and is projected from said channel to noninjuriously engage said paper machine forming screen such that said blade edge acts as a partial fluid seal between said support body and said forming screen.

2. The paper machine deckle blade assembly as described by claim 1 wherein said polytetrafluoroethylene blade edge is secured within said channel by transverse shear pin means.

3. The paper machine deckle blade assembly as described by claim 1 wherein said plates are secured to said support body by bonding compounds.

4. The paper machine deckle blade assembly as described by claim 3 wherein said polytetrafluoroethylene blade edge is secured between said plates by a plurality of adhesively anchored dowel pins.

5. The paper machine deckle blade assembly as described by claim 3 wherein said polytetrafluoroethylene blade edge is secured between said plates by a plurality of expansively anchored dowel pins.

6. The paper machine deckle blade assembly as described by claim 3 wherein said polytetrafluoroethylene blade edge is secured between said plates by a plurality of flush surface threaded compression pins.

* * * * *